US006467901B2

(12) United States Patent
Von Inten

(10) Patent No.: US 6,467,901 B2
(45) Date of Patent: Oct. 22, 2002

(54) DEVICE FOR PRINTING A PRINT CARRIER

(75) Inventor: Wolfgang Von Inten, Berlin (DE)

(73) Assignee: Francotyp-Postalia AG & Co., KG, Birkenwerder (DE)

( * ) Notice: Subject to any disclaimer, the term of this patent is extended or adjusted under 35 U.S.C. 154(b) by 0 days.

(21) Appl. No.: 09/900,667

(22) Filed: Jul. 6, 2001

(65) Prior Publication Data

US 2002/0003565 A1 Jan. 10, 2002

(30) Foreign Application Priority Data

Jul. 6, 2000 (DE) ..... 100 32 855

(51) Int. Cl.[7] ..... B41J 2/01
(52) U.S. Cl. ..... 347/104
(58) Field of Search ..... 347/2, 101, 104; 400/636, 637; 101/66, 71, 76, 91

(56) References Cited

U.S. PATENT DOCUMENTS

| | | | | |
|---|---|---|---|---|
| 3,869,986 A | | 3/1975 | Hubbard | |
| 4,821,049 A | * | 4/1989 | Eckl | 346/134 |
| 5,455,604 A | * | 10/1995 | Adams et al. | 346/138 |
| 5,467,709 A | | 11/1995 | Salomon | |
| 5,648,811 A | | 7/1997 | Thiel et al. | |
| 5,757,387 A | * | 5/1998 | Manduley | 347/2 |

FOREIGN PATENT DOCUMENTS

| | | |
|---|---|---|
| DE | 25 01 035 C2 | 7/1975 |
| DE | 31 44 388 A1 | 5/1983 |
| DE | 90 00 255.5 | 6/1991 |
| DE | 42 28 765 A1 | 3/1994 |
| EP | 0 436 919 B1 | 7/1991 |
| WO | WO 99/44174 | 9/1999 |

* cited by examiner

*Primary Examiner*—Raquel Gordon
*Assistant Examiner*—Ly T Tran
(74) *Attorney, Agent, or Firm*—Laurence A. Greenberg; Werner H. Stemer; Ralph E. Locher

(57) ABSTRACT

A device for printing a print carrier in the printing region makes use, in a force transmission region, of a driven transport drum and non-driven back-pressure rollers or, alternatively, of a non-driven back-pressure conveyor belt. A stationary ink-jet printing head prints, in the printing region, the print carrier that is moved downstream, the ink-jet printing head being disposed axially relative to the transport drum. The printing region amounts preferably to about 1 inch and is at a distance from the force transmission region, the distance of the furthest pixel from the edge of the transport drum, being smaller than the radius of the circumference of the transport drum.

24 Claims, 3 Drawing Sheets

DEVICE FOR PRINTING A PRINT CARRIER

BACKGROUND OF THE INVENTION

Field of the Invention

The invention relates to a device for printing a print carrier in a printing region using a stationary ink-jet printing head and with a print carrier moved downstream in the Z-direction of the printing region. The invention is employed in fully electronic digital printing devices in which recording carriers have variable dimensions (i.e. thickness and size). It is particularly suitable for use in voucher printers, franking machines, addressing machines and other mail processing appliances with a transport and printing device for mail items.

German Patent DE 25 01 035 C2 discloses a printing drum with a single ink-jet printing head. The printing drum has a transport function and a printing function, and therefore the ink-jet printing head cannot print the entire printing region. Variable information can be printed only by the ink-jet printing head. Regions in which the printing information cannot, in principle, be changed therefore remain in the printing image.

Modern franking machines, such as, for example, the thermotransfer franking machine known from U.S. Pat. No. 4,746,234, employ fully electronic digital printing devices. It is consequently possible, in principle, to print any desired texts, codes and special characters in the franking-stamp printing region and any desired advertising block print or one assigned to a cost center. A franking machine, for example T1000 from the applicant Francotyp-Postalia AG & Co., is controlled by a microprocessor control surrounded by a secured housing which has an orifice for feeding a letter. Whenever a letter is fed, a mechanical letter sensor (microswitch) transmits a print demand signal to the microprocessor which generates a printing image and, after billing the mailing value to be franked, triggers printing. The franking imprint contains previously entered and stored mail information for transporting the letter.

U.S. Pat. No. 5,467,709 discloses a printing device for an ink-jet franking machine, a franking print being printed onto a mail item by an ink-jet printing head during approximately horizontal letter transport. For printing, the ink-jet printing head is disposed in a stationary manner in a recess behind a guide plate. A rotating transport belt serves as a transport device and is likewise disposed at the side of the guide plate. A back-pressure device with a plurality of rollers is disposed on the other side, opposite the guide plate, so that a fed mail item is clamped between the rollers of the back-pressure device and the rotating transport belt. However, the configuration cannot prevent the print carriers from running askew. Even an insufficiently tensioned transport belt or a not exactly parallel alignment of the axes of those rollers on which the transport belt rotates gives rise to the above-mentioned risk. Due to the multiplicity of rollers of the back-pressure device, the latter is dynamically redundant.

German Patent DE 196 05 015 C1, corresponding to U.S. Pat. No. 5,949,444, has already proposed a version of a printing device of a JETMAIL ink-jet franking machine of the applicant Francotyp-Postalia AG & Co., which, in the case of nonhorizontal approximately vertical letter transport, executes a franking print by an ink-jet printing head which is disposed in a stationary manner in a recess behind a guide plate. A rotating transport belt serves as a transport device, with pressure elements for the mail items (letters with a thickness of up to 20 mm, DIN B4 format) or for franking strips that are configured to be capable of being glued onto packets of any thickness. The print carrier (letter, packet, franking strip) is clamped between the pressure element and the guide plate.

The transport and printing device is disposed in the base and is controlled by a meter. A trigger sensor for the printing process is disposed in the base, just in front of the ink-jet printing head recess, for detecting the start of a letter and cooperates with an incremental generator on the drive of the transport belt. By use of a transmitted-light barrier as a trigger sensor (Published, European Patent Application EP 0 901 108 A2), the leading edge of even especially thick mail items is detected unequivocally. Moreover, optical sensors for detecting the build-up of mail items are employed in the base of the JETMAIL. An automatic feed and a dynamic balance are disposed in the CONDORD franking system upstream of the JETMAIL franking machine, thus allowing genuine mixed-mail processing for mail items of widely differing formats, thicknesses and weights. At very high printing speeds, it becomes increasingly more difficult to print a stamping print of relatively high quality that allows mechanical evaluation with a high degree of reliability. A rotating transport belt should therefore have no stretching, even under mechanical and thermal load, and the pressure elements should not allow any slip during the transport of the mail items. Only transport and printing devices that are of complicated constructions and are cost-intensive have hitherto satisfied these requirements.

There have also already been proposed more simply constructed transport and drive devices without back-pressure device (German Patent DE 196 05 014 C1) or with a back-pressure device (International Patent Disclosure WO 99/44174) in the vicinity of the printing region of at least one ink-jet printing head. In International Patent Disclosure WO 99/44174, the latter is disposed downstream of a pair of draw-in rollers in the transport direction, the upper roller being driven and the lower back-pressure roller being sprung. A further pair of rollers downstream of the ink-jet printing head, near the ejection, likewise exerts a force on the print carrier. The printing region is at a distance from the force transmission region of one of the pairs of rollers of more than one radius of the respectively driven roller. Although, in principle, the printing information can be changed in all regions as a result of digital printing, the print is nevertheless of lower quality, the higher the selected transport speed. In particular, when two ink-jet printing heads are employed, an offset may occur in the printing image (correspondence error) along a printing length in the transport direction, thus making the mechanical evaluation of the printing image more difficult. The force action of the further pair of rollers downstream of the ink-jet printing head, near the ejection, leads to a different path length and therefore, in the case of two ink-jet printing heads offset to one another, to the correspondence error in the printing image. The print quality demanded within the framework of current programs of the mail service providers, for example the information-based Indicia program of the USPS, could therefore be achieved only at the expense of a low printing speed. Another disadvantage is the small thickness of the print carriers that can be printed by such a simply constructed printing device.

SUMMARY OF THE INVENTION

It is accordingly an object of the invention to provide a device for printing a print carrier which overcomes the above-mentioned disadvantages of the prior art devices of this general type, which makes it possible, even at very high printing speeds, to have a print of higher quality. Printing is to take place directly onto print carriers that have a thickness of up to 10 mm.

With the foregoing and other objects in view there is provided, in accordance with the invention, a printing device containing a driven transport drum and a non-driven back-pressure device resilient in a Y-direction and disposed opposite the driven transport drum. The driven transport drum and the non-driven back-pressure device define a force transmission region there-between and exert a transport force on a print carrier in the force transmission region. An ink-jet printing head is disposed axially relative to the driven transport drum in an X-direction. The print carrier is printed on in a printing region by the ink-jet printing head and the print carrier is moved downstream in a Z-direction in the printing region. The printing region is at a distance from the force transmission region, and the X-direction is orthogonal to the Z-direction and orthogonal to the Y-direction.

A rotating transport drum serves as the transport device and is disposed on the same side of the guide plate as the ink-jet printing head. The resilient back-pressure device is disposed on the other side, opposite the transport drum, so that a fed print carrier (i.e. letter) is clamped between the transport drum and the back-pressure roller of the back-pressure device. The clamping location is referred to hereafter as the force transmission region, because the force for transporting in the transport direction is transmitted to the print carrier there. None of the back-pressure rollers of the back-pressure device is disposed opposite the ink-jet printing head. The ink-jet printing head is at a distance, or the one hand, from the transport drum in the axial direction and, on the other hand, from the contact surface between the guide plate and print carrier, both distances being minimized. The printing region is offset relative to the force transmission region in the X-direction and is located at the edge of the printing drum. For printing, the at least one ink-jet printing head is disposed in a stationary manner behind a guide plate in a recess which starts at the edge of the printing drum. The imprint is applied contactlessly to the print carrier in the printing region during the transport of the print carrier in the Z-direction. The printing device may be configured for approximately horizontal, inclined or vertical transport of the print carrier in the Z-direction. For example, in a franking machine with the at least one ink-jet printing head, a franking print of high print quality is printed onto a moved mail item in the printing region. Although the transport drum is very large, so that even relatively thick mail items are properly picked up and transported, in the device according to the invention the furthest pixel of the printing region is nevertheless nearer to the force transmission region than corresponds to the radius of the transport drum.

The device for printing a print carrier in the printing region makes use, in the force transmission region, of a driven transport drum and non-driven back-pressure rollers or, alternatively, a non-driven back-pressure conveyor belt of the back-pressure device.

In accordance with an added feature of the invention, the driven transport drum has an edge and a radius of a circumference. And a distance of a furthest pixel in the printing region from the edge of the driven transport drum is smaller than the radius of the circumference of the driven transport drum.

In accordance with an additional feature of the invention, a housing having a slit-shaped orifice formed therein is provided. The driven transport drum and the non-driven back-pressure device are disposed in the housing. The driven transport drum and the back-pressure device exert the transport force on the print carrier in an area of the slit-shaped orifice of the housing. The slit-shaped orifice has a depth extending in the X-direction orthogonally to the Z-direction for the print carrier moved downstream, so that the force transmission region and the printing region are disposed within the slit-shaped orifice. The driven transport drum has a bearing axle running parallel to the X-direction and has an orifice formed therein. The ink-jet printing head has nozzles and an ink container disposed in the X-direction with the ink container at least partially in the orifice of the driven transport drum in such a way that the nozzles are located at the edge of the driven transport drum for emitting ink drops on demand, opposite to the Y-direction, onto a surface of the print carrier in the printing region. And the non-driven resilient back-pressure device exerts a spring pressure in the Y-direction.

In accordance with another feature of the invention, the non-driven back-pressure device has non-driven back-pressure rollers functioning as resilient devices.

In accordance with a further feature of the invention, the non-driven back-pressure device has at least one non-driven back-pressure conveyor belt functioning as a resilient device.

In accordance with a further added feature of the invention, a motor is disposed in the housing. A guide plate against which the print carrier rests and has a guide plate orifice formed therein is disposed on one side of the slit-shaped orifice of the housing. The driven transport drum exerts the transport force on the print carrier in a transport direction through the guide plate orifice in the guide plate when the motor is activated. A feed deck is disposed opposite the guide plate, on another side of the slit-shaped orifice of the housing. The feed deck has feed deck orifices formed therein for receiving the resilient devices of the non-driven back-pressure device. The feed deck orifices include a first orifice and a second orifice and the guide plate orifice and the first orifice of the feed deck are located opposite one another.

In accordance with another added feature of the invention, the guide plate has a further guide plate orifice formed therein for ink-jet printing from the nozzles of the ink-jet printing head. The further guide plate office is disposed next to the guide plate orifice so as to be offset in the X-direction.

The further guide plate orifice has a size corresponding to the printing region.

In accordance with further additional feature of the invention, a driven draw-in roller is provided. The guide plate has a further guide plate orifice formed therein for receiving the driven draw-in roller, and the further guide plate orifice is disposed next to the guide plate orifice. The guide plate orifice for the driven transport drum is offset to the further guide plate orifice in the Z-direction.

In accordance with another additional feature of the invention, a non-driven draw-in roller is disposed in the second orifice of the feed deck. The first orifice and the second orifice of the feed deck are disposed next to one another such that the first orifice is offset to the second orifice in the Z-direction.

In accordance with an added feature of the invention, the guide plate has a further guide plate orifice formed therein for detecting the print carrier and is disposed next to the guide plate orifice for the driven transport drum. The guide plate orifice is offset to the further guide plate orifice in the Z-direction.

In accordance with an additional feature of the invention, the second orifice of the feed deck is provided for detecting the print carrier and is disposed next to the first orifice of the feed deck such that the first orifice is offset to the second orifice in the Z-direction.

In accordance with another feature of the invention, the non-driven back-pressure device has a first fixed bearing axle, a resilent rocker mounted pivotably about the first fixed bearing axle, a first axle fastened on the resilent rocker, and a first tension spring acting on the resilent rocker. The non-driven back-pressure rollers are mounted rotatably on the first axle and act on the print carrier through the first orifice in the feed deck by a spring force of the first tension spring.

In accordance with a further feature of the invention, a pilot control mechanism having a front and disposed upstream of the non-driven back-pressure device is provided. The pilot control mechanism has a second fixed bearing axle, a sprung rocker disposed at the front along the transport path and is mounted pivotably about the second fixed bearing axle, a second axle fastened to the sprung rocker, a second tension spring acting on the sprung rocker, and a non-driven draw-in roller mounted rotatably on the second axle. An upper draw-in roller is disposed above the non-driven draw-in roller and the non-driven draw-in roller acts the upper draw-in roller or on the print carrier through the second orifice in the feed deck by a spring force of the second tension spring. A lifting rod is provided for coupling the sprung rocker to the resilent rocker in such a way that a movement of the sprung rocker caused by a thickness of the print carrier is transmitted at least partially to the resilent rocker being a rear rocker.

In accordance with a further added feature of the invention, the first tension spring has a spring constant being substantially higher than that of the second tension spring.

In accordance with a further additional feature of the invention, the sprung rocker and the resilent rocker are each formed of two angle levers including a first angle lever and a second angle lever each having legs including a first leg and a second leg. The sprung rocker and the resilent rocker each have a first spacer piece connected between the first leg of the two angle levers, a second spacer piece connected between the first leg and the second leg of each of the two angle levers, and a bolt fastened to the second leg of the first angle lever and the second leg of the second angle lever for spring suspension.

In accordance with another added feature of the invention, the lifting rod has a first hole and a second hole formed therein at opposite ends of the lifting rod. The sprung rocker has a further bolt disposed along the transport path and is held in the first hole at one end of the lifting rod. The bolt of the rear rocker is disposed along the transport path and is held in the second hole at the other end of the lifting rod.

In accordance with an added feature of the invention, the non-driven back-pressure device has a sprung long rocker, first axles fastened on the sprung long rocker, and supporting rollers mounted rotatably on the first axles. The non-driven back-pressure conveyor belt runs on tile supporting rollers. The non-driven back pressure device has second axles fastened on the sprung long rocker and deflecting rollers for the non-driven back-pressure conveyor belt are mounted rotatably on second axles. The non-driven back pressure device has a sprung short rocker, a third axle fastened on the sprung short rocker, and a non-driven lower draw-in roller mounted rotatably on the third axle. The non-driven back pressure device has a common fixed bearing axle and the sprung long rocker and the sprung short rocker are mounted pivotably about the common fixed bearing axle. The non-driven back pressure device has a feed deck with a first orifice and a second orifice formed therein, a first compression spring and a second compression spring. The non-driven back-pressure conveyor belt acts on the print carrier through the first orifice in the feed deck by a spring force of the first compression spring, and the non-driven lower draw-in roller acting on the print carrier through the second orifice in the feed deck by a spring force of the second compression spring.

In accordance with an additional feature of the invention, the first compression spring has a spring constant substantially higher than that of the second compression spring.

In accordance with another feature of the invention, the locking nuts fasten the second axles to the sprung long rocker.

In accordance with a further feature of the invention, at least one friction covering rests annularly against a circumference of the driven transport drum.

In accordance with another added feature of the invention, the driven transport drum has a bearing axle. A worm wheel, a drive belt, and a driving wheel driven by the drive belt are disposed near one end face of the driven transport drum on the bearing axle of the driven transport drum. A motor driving the driven transport drum is provided. The motor has a motor axle and a worm pinion disposed on the motor axle and engages the worm wheel. A driven wheel and an upper draw-in roller coupled to the driven wheel which is driven by the drive belt, are provided.

In accordance with yet another feature of the invention, the driving wheel and the driven wheel are toothed-belt wheels, and the drive belt is a toothed belt.

In accordance with a further feature of the invention, an encoder disk, which can be sensed by a light barrier in an encoder, is disposed on the motor axle.

In accordance with a concomitant feature of the invention, the driven transport drum has an end face with markings disposed on the end face, near a circumference of the driven transport drum to be read by an encoder.

Other features which are considered as characteristic for the invention are set forth in the appended claims.

Although the invention is illustrated and described herein as embodied in a device for printing a print carrier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
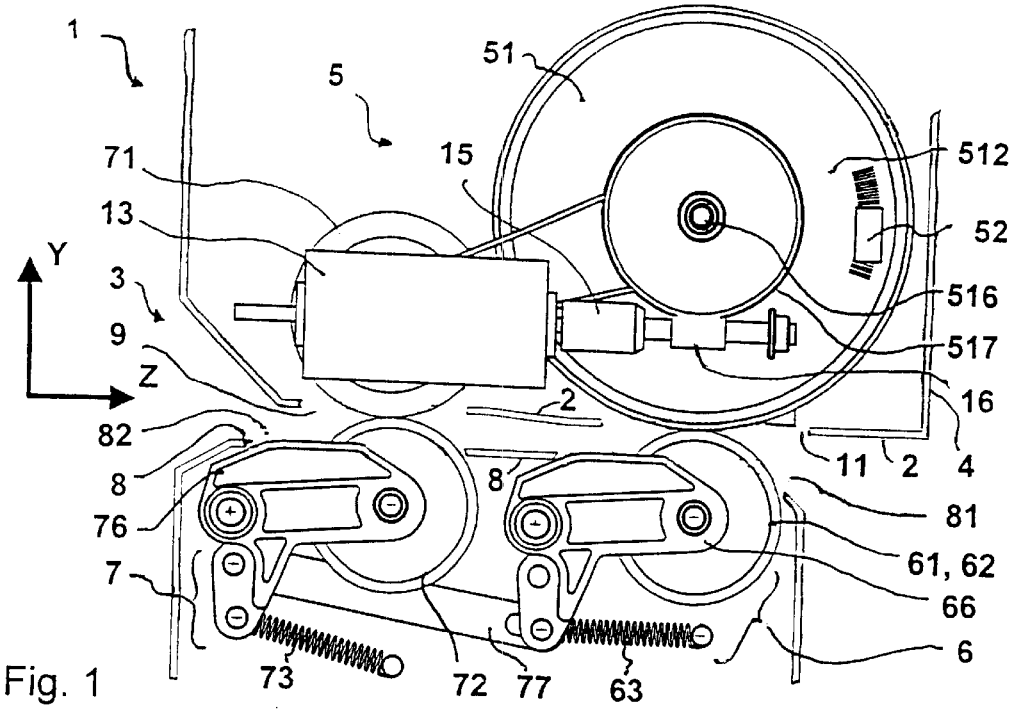
FIG. 1 is a sectional view through a front side of a printing device with a transport and back-pressure device, in a first variant, according to the invention.

In all the figures of the drawing, sub-features and integral parts that correspond to one another bear the same reference symbol in each case. Referring now to the figures of the drawing in detail and first, particularly, to FIG. 1 thereof, there is shown a section through the front view of a printing device 1 with a transport and back-pressure device in a first variant. Such a printing device may be employed in a franking machine, an addressing machine or another mail processing appliance with mail-item transport. The printing device 1 is disposed in a housing 4 with an orifice 3 for the mail-item feed.

A transport direction for a fed mail item is marked by an arrow and runs downstream from left to right in the Z-direction. The mail item, when being transported, comes to rest against a guide plate 2. A transport and drive device 5 is located on one side of the guide plate 2. A driven draw-in roller 71 is likewise located on the same side of the guide plate 2. A motor 13 generates the drive force required. Orifices 9 and 11 for the driven draw-in roller 71 and for a driven transport drum 51 are disposed in the guide plate 2 so as to be offset in the Z-direction.

A nondriven back-pressure device 6 and a nondriven pilot-control mechanism 7 are disposed on the other side, opposite the guide plate 2. A feed deck 8 limits the thickness of the fed mail item to 10 mm. Orifices 81, 82 are disposed, offset in the Z-direction, in the feed deck 8. The orifices 11, 81 and 9, 82 are located opposite one another. The orifice 81 is provided for back-pressure rollers 61, 62 of the back-pressure device 6, which are mounted on a resilient rocker 66, and the orifice 82 is provided for a draw-in roller 72 of the pilot-control mechanism 7, the draw-in roller being mounted on a resilient rocker 76. The rockers 66, 76 are formed preferably in each case from two angle levers which are mounted pivotably at a fixed location and on which a spring 63, 73 acts in each case. The angle levers are coupled to one another via a lifting rod 77.

Figure 2:
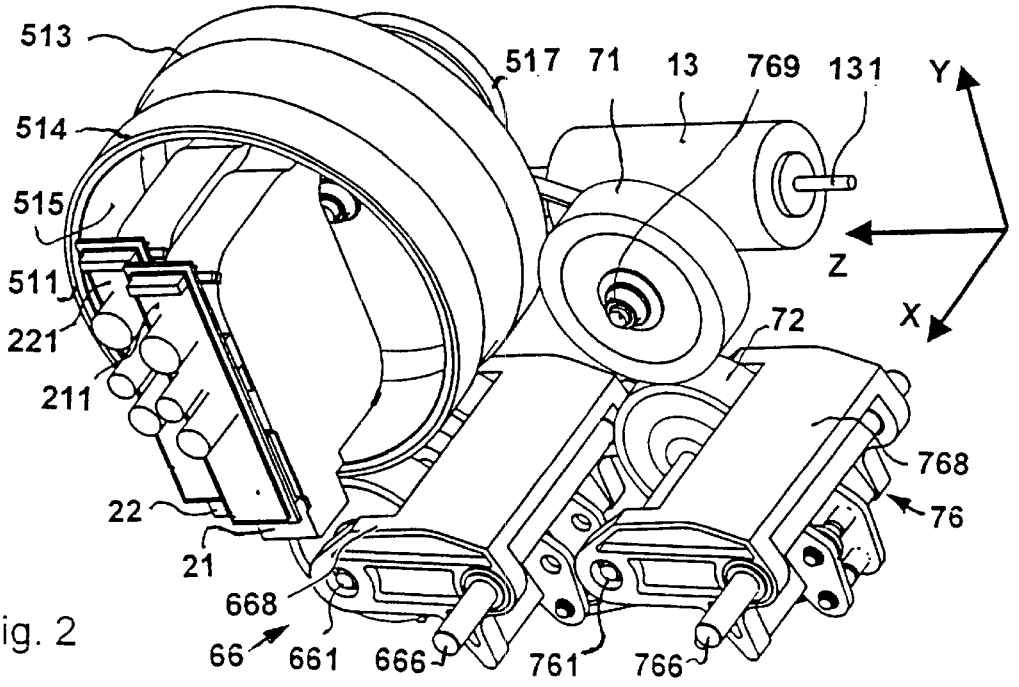
FIG. 2 is a perspective, rear view of the printing device from above.

For a highly accurate transmission of the drive force to the print carrier, the transport drum 51 is employed, inside which there is sufficient room for accommodating ink containers (cartridges) of two ink-jet printing heads 21, 22 (FIG. 2). The printing device thereby has a highly compact construction. The two ink-jet printing heads 21, 22, which are disposed with their ink containers in the transport drum 51 and in FIG. 1 are concealed by the latter, are disposed exchangeably. For example, ½-inch bubble-jet printing heads can be used and can be taken out in the Y-direction after they have first been moved in the X-direction. The X-direction and Y-direction are orthogonal to the transport direction (Z-direction).

A bearing axle 516 of the transport drum 51 is parallel to the X-direction. A worm wheel 517 is fastened on the bearing axle 516 and is connected to a motor axle 131 of the direct-current motor 13 via a worm pinion 16 and a coupling sleeve 15. The ink-jet printing head 21, 22 (see FIG. 2) is disposed in the X-direction, in such a way that its nozzles are located at the edge of the transport drum 51, in order to emit ink drops on demand, opposite to the Y-direction, onto a surface of the print carrier in the printing region. Nozzles of the two ink-jet printing heads 21, 22 are oriented in the direction of the print carrier orthogonally to the transport direction and orthogonally to the bearing axle 516 of the transport drum 51.

There is provision for disposing an orifice 111, not shown, in the guide plate 2 next to the orifice 11, so as to be offset in the X-direction, for ink-jet printing from the nozzles of the ink-jet printing head 21, 22, the orifice 111 having a size corresponding to the printing region.

The compact device, in which the nozzles of the ink-jet printing heads 21, 22 are disposed so near to an edge 511 of the transport drum 51 that virtually no distortions can occur in the printing image, is, of course, advantageous. A further advantage is that the transport drum 51 can be manufactured with high precision in an uncomplicated way, thus giving rise to a uniform transport of the print carriers (i.e. mail items) under the ink-jet printing heads 21, 22.

A non-illustrated main circuit board for control controls the printing device. Markings are applied to an end face 512 of the transport drum 51, near a circumference of the transport drum 51, and are distributed over the circumference. The markings are, for example, reflecting dashes that are detected by a reflex-light barrier of an encoder 52 and are converted by the microprocessor of the above-mentioned control into printing pulses in the ratio 1:1. Fluctuations in the transport speed therefore have no influence on a printing image produced.

Alternatively to this, the encoder 52 may be disposed on the motor axle 131.

FIG. 2 shows a perspective rear view of the printing device 1 from above. The mail-item feed again takes place in the Z-direction. The transport drum 51 is set in motion by the motor 13, via the worm wheel 517 fastened on the bearing axle 516, when a non-illustrated sensor for mail-item detection emits a signal and the microprocessor establishes a printing demand.

Figure 3:
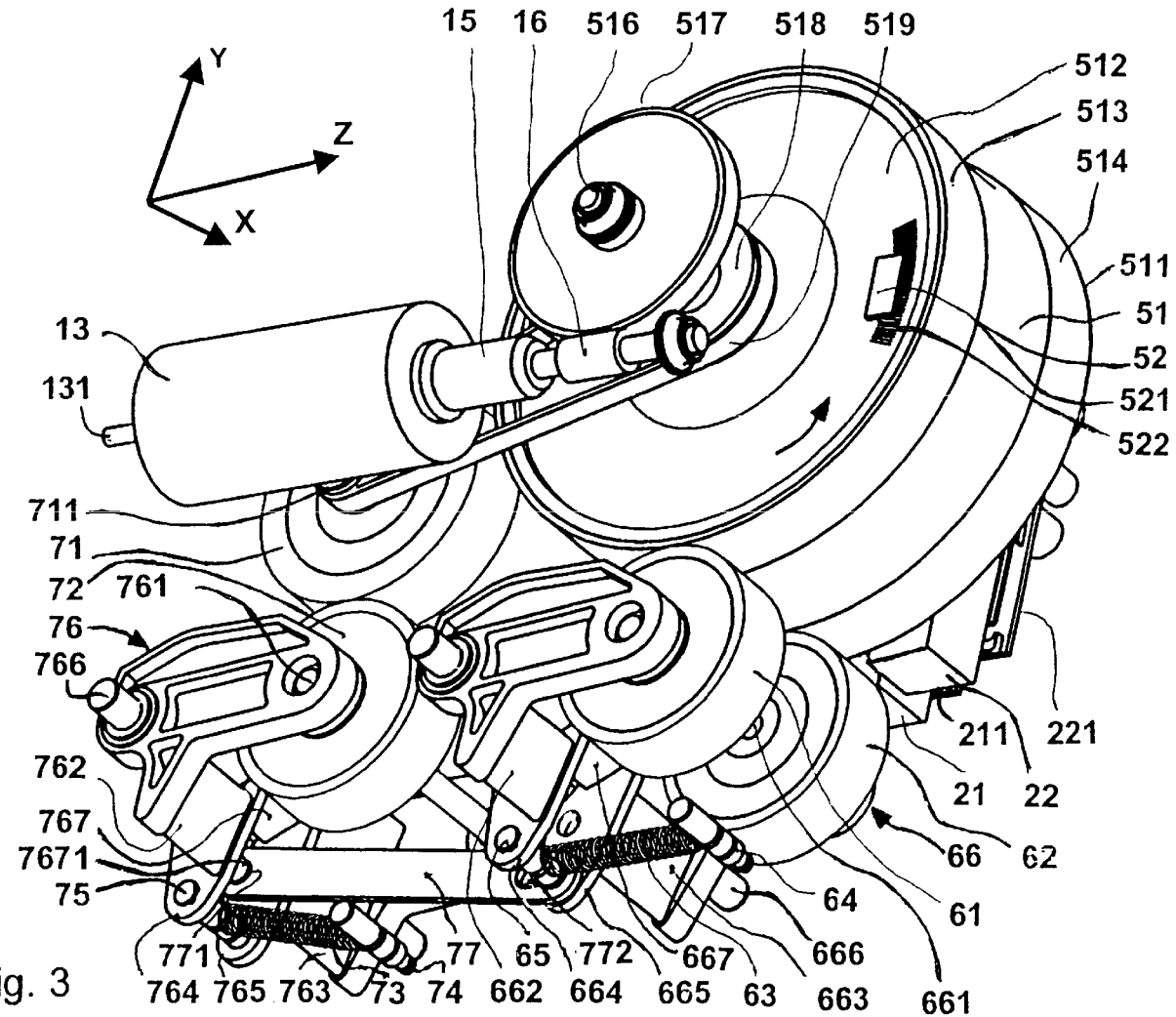
FIG. 3 is a perspective, front view of the printing device from below.

Located upstream are the driven draw-in roller 71, on the same side of the guide plate 2 as the transport drum 51, and the draw-in roller 72 of the additional pilot-control mechanism 7 for drawing in print carriers (letters, mail items) up to 10 mm. The upper draw-in roller 71 is coupled to a driven wheel 711 which is driven via a drive belt 519 which is set in motion by a driving wheel 518 on the bearing axle 516 (FIG. 3). The driving wheel 518 and the driven wheel 711 are, for example, toothed-belt wheels and the drive belt 519 is a toothed belt. The non-driven draw-in roller 72 is mounted rotatably on an axle 761 of the front rocker 76 of the pilot-control mechanism 7. The mutually parallel legs that carry the axle 761 of the draw-in roller 72 are connected fixedly via a spacer piece 768. The rocker 76 is mounted pivotably about a fixed bearing axle 766. Any influence exerted on the printing image by the pair of draw-in rollers is ruled out in that the pressure forces and coefficients of friction between the transport drum 51 and a back-pressure roller 61 are configured to be at least one order of magnitude higher than those with respect to the pairing of the draw-in rollers 71, 72. To increase the coefficients of friction, the transport drum 51 has, on its outer surface, at least one annular friction covering 513, 514 conforming to the circumference of the transport drum 51. The back-pressure rollers 61, 62 are mounted rotatably on an axle 661 of the rear rocker 66 of the back-pressure device 6. The mutually parallel legs of the rocker 66, the legs carrying the axle 661 of the rollers 61, 62, are connected via a spacer piece 668. The rocker 66 is mounted pivotably about a fixed bearing axle 666. The transport drum 51 and the sprung back-pressure rollers in the vicinity of the printing region makes it possible to dispense with further devices for transport downstream in the region of the print-carrier ejection. This rules out the situation where the further device of transport leads to a print offset.

The two ½-inch ink-jet printing heads 21, 22 project with their ink containers into the orifice 515 of the transport drum 51. This ensures that the 1-inch printing region is very near to the force transmission region. The correspondence side of the ½-inch ink-jet printing head 21, 22 lies in the X-direction and is configured in a particular predetermined way. Corresponding contacting units 211 and 221 are adapted to the correspondence side of the ½-inch ink-jet printing heads 21, 22 for electronic signal conversion and mechanical connection.

FIG. 3 illustrates a perspective front view of the printing device from below. Advantageously, the rockers 66 and 76 are formed in each case from two angle levers 662, 663 and 762, 763 mounted pivotably at a fixed location. The two angle levers 662, 663 and 762, 763 of each of the rockers 66 and 76 are parallel to one another. They are fixedly connected to one another with their first legs, which in each case carry the axles 661 and 761 of the rollers 61, 62 and 72, via a spacer piece 668 and 768 and with their second legs 664, 665 and 764, 765 via a spacer piece 667 and 767. A bolt 65 or 75 is fastened for spring suspension to the latter legs 664, 665 and 764, 765 respectively. Advantageously, the rockers 66 and 76 can be produced as a plastic molding by the injection-molding method.

The rockers 66 and 76 in each case pivot about the fixed bearing axles 666 and 766. However, the pivoting of the rocker 76 takes place by virtue of the thickness of a print carrier, but that of the rocker 66 takes place by virtue of the coupling of the latter to the front rocker 76 via a lifting rod 77. The springs counteracting the respective differing outward pivoting of the rockers 66 and 76 are configured as tension springs 63 and 73, the tension springs acting on the legs 664, 665 and 764, 765 of the angle levers 662, 663 and 762, 763 and being fastened to a bolt 65 or 75 for spring suspension. The tension springs 63 and 73 are fastened at the other end to a fixed bolt 64 and 74 respectively for spring suspension. The fixed bolts 64 and 74 are an integral part of a supporting frame, not shown, or of the housing 4 or are fastened to the latter in a way known per se.

Due to the spring force of at least the first tension spring 63, the back-pressure rollers 61, 62 act on the print carrier through the orifice 81 in the feed deck 8. Due to the spring force of the second tension spring 73, the lower draw-in roller 72 can act on the upper draw-in roller 71 or on the print carrier through the Orifice 82 in the feed deck 8. In this case, the orifice 82 is disposed next to the orifice 81, the orifice 81 being offset to the further orifice 82 in the Z-direction. The tension spring 63 of the rear rocker 66 and the tension spring 73 of the front rocker 76 exert in each case a sprung back pressure on the print carrier resting against the driven draw-in roller 71, against the driven transport drum 51 or against the guide plate 2. The print carrier is, for example, a mail item, not illustrated in FIG. 3.

The legs 664, 665 of the angle levers of the rear rocker 66 are coupled to the legs 764, 765 of the angle levers of the front rocker 76 via the lifting rod 77, in such a way that an opening of the front rocker 76 having the draw-in roller 72 results in a lesser opening of the rear rocker 66 having the back-pressure roller 61, 62. A movement of the front rocker 76 caused by the thickness of the print carrier is transmitted at least partially to the rear rocker 66. For this purpose, a bolt 7671, of the front rocker 76 along a transport path, is disposed in a hole 771 of the lifting rod 77 at one end of the latter. The bolt 65, of the rear rocker 66 along the transport path, is disposed in a long hole 772 of the lifting rod 77 at the other end of the latter. The long hole 772 in the lifting rod 77 makes it possible, on the one hand, for the rear rocker 66 having the back-pressure rollers 61, 62 to open further and, on the other hand, for the draw-in rollers 71, 72 to close. The spring constant of the tension spring 63 is substantially higher than, but at least double, that of the tension spring 73. For example, a pressing force of 5 to 20 Newton prevails between the draw-in rollers 71, 72, but a pressing force of 10 to 50 Newton prevails between the transport drum 51 and the back-pressure rollers 61, 62, so as not to influence adversely the transport or the printing image by the pilot control.

Figure 4:
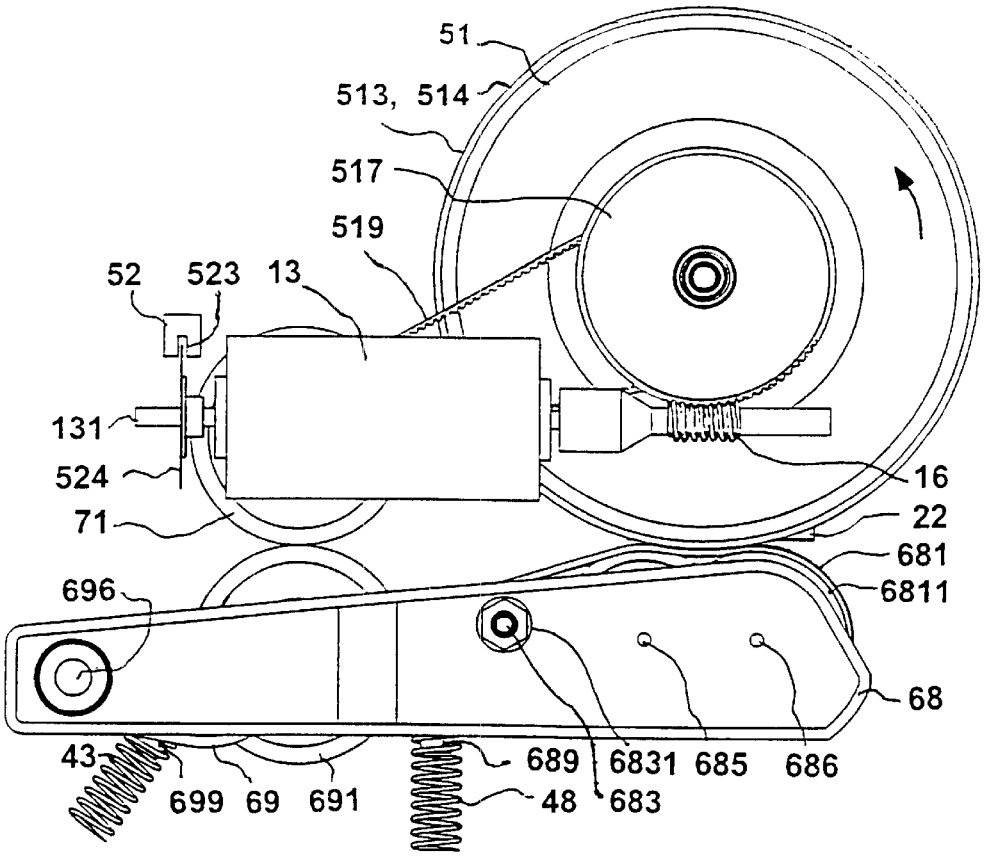
FIG. 4 is a sectional view through the front side of the printing device with the transport and back-pressure device, in a second variant.

FIG. 4 illustrates a section through the front view of the printing device with the transport and back-pressure device 5 according to a second variant. The transport and drive device 5 corresponds essentially to the device already explained according to the first variant. However, the guide plate 2 and the feed deck 8, including the orifices therein, have been omitted for reasons of simplification. Another difference is the configuration of the encoder 52 near the motor axle 131. Fastened on the motor axle 131 is an encoder disk 524 that a light barrier 523 of the encoder 52 senses. Alternatively to this, the encoder 52 may be disposed on the transport drum 51. The back-pressure device 6 according to the second variant is formed of at least one long rocker 68 mounted pivotably at a fixed location and of at least one short rocker 69 mounted pivotably at a fixed location. The above-mentioned rockers in each case pivot about a fixed bearing axle 696, in each case counter to a spring force. It should be stressed, as regards the back-pressure device 6 according to the second variant, that this manages without a pilot-control mechanism. Since two annular friction coverings 513 and 514 for increasing the coefficients of friction are disposed on the outer surface of the transport drum 51 in conformity to the circumference of the latter, the back-pressure device 6 is equipped with two long rockers 67, 68 which are mounted pivotably at a fixed location and each carry at least one non-driven back-pressure conveyor belt 671, 672 and 681, 682. The latter draws even relatively thick mail items into the force transmission region, without the pilot-control mechanism 7, and then adapts more closely to the mail item resting against the circumference of the transport drum 51 and increases the feeding surface between the mail item and the transport drum 51. Supporting rollers 6711, 6721, 674 and 6811, 6821, 684 are mounted rotatably on axles 675, 676 and 685, 686. The back-pressure conveyor belt can be pretensioned by an axle 673 and 683 of the inner deflecting rollers. The axle 673 and 683 can be fixed by a locking nut 6731 and 6831.

Figure 5:
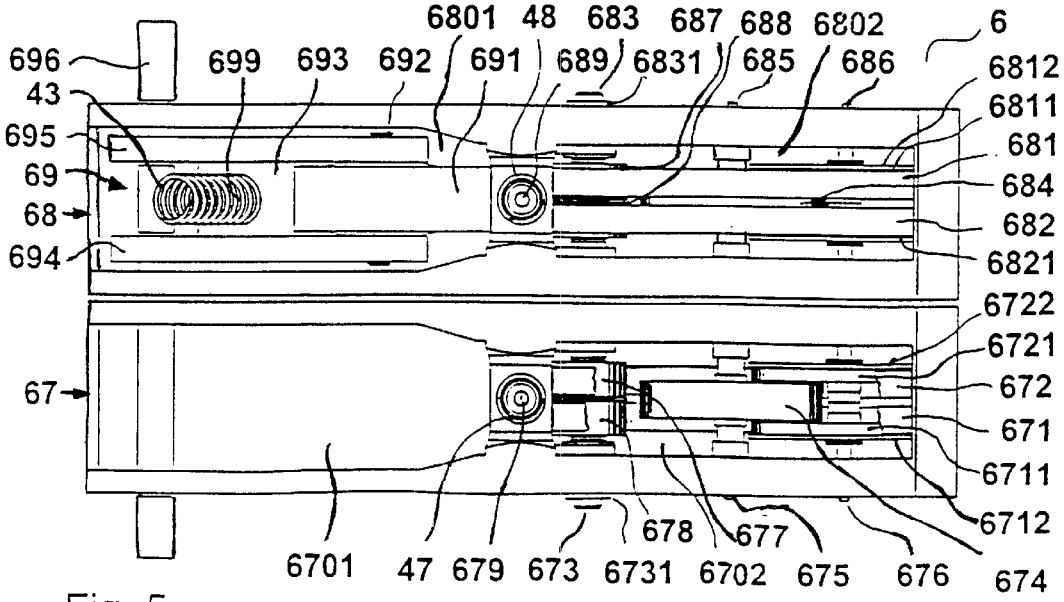
FIG. 5 is a sectional view from below of the back-pressure device according to the second variant.

FIG. 5 shows a view from below of the back-pressure device 6 according to the second variant. The construction of the long rockers 67, 68 is preferably approximately identical. The construction is in each case box-shaped with a middle web carrying a spring guide boss 679, 689, on which engages one side of a compression spring 47, 48 which is supported on its other side (in a way not shown) on the bottom or frame of the housing 4. Only one of the two long rockers 67, 68 mounted pivotably at a fixed location has the integrated short rocker 69 which is mounted pivotably at a fixed location and which is likewise supported on the housing bottom or on the frame via a spring guide boss 699 and a compression spring 43. The short rocker 69 is mounted pivotably on the common fixed bearing axle 696 and carries a lower non-driven draw-in roller 691 (FIG. 4). A non-illustrated sensor for mail-item detection is also disposed, upstream of the pair of draw-in rollers 71, 691, in corresponding further orifices in the guide plate 2 and/or in the feed deck 8. The measurement location is disposed in the vicinity of the transport path upstream of one of the printing heads positioned in the printing position. Disposed at the measurement location in the orifice 3 are rigid light guide elements which are configured as transparent plastic light guides for fixing and focusing an IR light beam and which transmit IR light to a main circuit board 14 of the housing bottom. An interruption in the IR light beam leads to the activation of the motor 13.

The short rocker 69 is mounted pivotably on the common fixed bearing axle 696 in a first box-shaped orifice 6801 of the long rocker 68. The short rocker has two legs 694, 695 and carries the lower non-driven draw-in roller 691 rotatably on an axle 692 disposed between the two legs. A middle piece 693 between the legs 694, 695 of the short rocker 69 carries the spring guide boss 699.

The compression spring 43 of the short rocker 69 and the compression springs 47, 48 of the long rockers 67, 68 bring about a sprung back pressure on a print carrier resting against the driven draw-in roller 71, against the driven transport drum 51 or against the guide plate 2. Due to a spring force of the first compression spring 47, 48, the non-driven back-pressure conveyor belt 671, 672 or 681, 682 acts on the print carrier through the orifice 81 in the feed deck 8. A spring constant of the first compression spring 47, 48 is substantially higher than that of the second compression spring 43. Due to a spring force of the second compression spring 43, the non-driven lower draw-in roller 691 acts on the print carrier 12 through the orifice 82 in the feed deck 8 and lays the print carrier against the guide plate 2 or against the driven draw-in roller 71. The lower non-driven draw-in roller 691 and the driven draw-in roller 71 form a pair or draw-in rollers 71, 691 which thus exerts a lower transport force on the print carrier, for example a mail item, not shown.

The at least one non-driven back-pressure conveyor belt 671, 672 or 681, 682 is mounted on rollers in a second box-shaped orifice 6702, 6802 or the at least one long rocker 67, 68. The non-driven back-pressure conveyor belt 671, 672 is depicted cut away for the purpose of explaining the roller configuration. The roller configuration is identical for each of the long rockers 67, 68. Two outer supporting rollers 6711, 6721 and 6811, 6821 are mounted rotatably on the axles 676 and 686 and are mounted at a distance from one another by spacer disks 6713, 6723 and 6813, 6823. A guide edge 6712, 6722 and 6812, 6822 of the outer supporting rollers prevents the above-mentioned back-pressure conveyor belt 671, 672 and 681, 682 from sliding down. A middle support roller 674 or 684 engages into the interspace of the outer supporting rollers located at a distance from one another and is mounted rotatably on the axle 675 and 685. The inner deflecting rollers 677, 678 and 687, 688 are mounted rotatably on the axles 673 and 683 and have a reduced diameter, as compared with that of other supporting rollers. This results in the back-pressure conveyor belt 671, 672 and 681, 682 being guided from the outset along an ascending run on the above-mentioned roller configuration as far as the middle supporting roller 674 and 684 in each case. By virtue of the above-mentioned guidance, an additional pilot-control mechanism may be dispensed with for mail-item thicknesses (letter thicknesses) of below 10 mm.

The invention is not restricted to the present embodiment. On the contrary, a number of variants may be envisaged within the scope of the claims. Thus, further different versions of the invention may obviously be developed or employed which, emanating from the same basic idea of the invention, are embraced by the accompanying claims.

I claim:

1. A printing device, comprising:

a driven transport drum;

a nondriven back-pressure device resilient in a Y-direction and disposed opposite said driven transport drum, said driven transport drum and said non-driven back-pressure device define a force transmission region there-between and exert a transport force on a print carrier in said force transmission region; and an ink-jet printing head disposed axially relative to said driven transport drum in an X-direction, the print carrier being printed on in a printing region by said ink-jet printing head and the print carrier being moved downstream in a Z-direction in said printing region, said printing region is at a distance from said force transmission region, and the X-direction being orthogonal to the Z-direction and orthogonal to the Y-direction.

2. The device according to claim 1, wherein said driven transport drum has an edge and a radius of a circumference, and a distance of a furthest pixel in said printing region from said edge of said driven transport drum is smaller than said radius of said circumference of said driven transport drum.

3. The device according to claim 2, including a housing having a slit-shaped orifice formed therein and said driven transport drum and said non-driven back-pressure device disposed in said housing, said driven transport drum and said back-pressure device exert the transport force on the print carrier in an area of said slit-shaped orifice of said housing, said slit-shaped orifice having a depth extending in the X-direction orthogonally to the Z-direction for the print carrier moved downstream, so that said force transmission region and said printing region are disposed within said slit-shaped orifice, said driven transport drum having a bearing axle running parallel to the X-direction and having an orifice formed therein, said ink-jet printing head having nozzles and an ink container disposed in the X-direction with said ink container at least partially in said orifice of said driven transport drum in such a way that said nozzles are located at said edge of said driven transport drum for emitting ink drops on demand, opposite to the Y-direction, onto a surface of the print carrier in said printing region, and said non-driven resilient back-pressure device exerting a spring pressure in the Y-direction.

4. The device according to claim 3, wherein said non-driven back-pressure device has non-driven back-pressure rollers functioning as resilient devices.

5. The device according to claim 4, including:

a motor disposed in said housing;

a guide plate against which the print carrier rests and having a guide plate orifice formed therein and said guide plate is disposed on one side of said slit-shaped orifice of said housing, said driven transport drum exerts the transport force on the print carrier in a transport direction through said guide plate orifice in said guide plate when said motor is activated; and a feed deck disposed opposite said guide plate, on another side of said slit-shaped orifice of said housing, said feed deck having feed deck orifices formed therein for receiving said resilient devices of said non-driven back-pressure device, said feed deck orifices include a first orifice and a second orifice and said guide plate orifice and said first orifice of said feed deck are located opposite one another.

6. The device according to claim 5, wherein said guide plate has a further guide plate orifice formed therein for ink-jet printing from said nozzles of said ink-jet printing head, said further guide plate office disposed next to said guide plate orifice so as to be offset in the X-direction, said further guide plate orifice having a size corresponding to said printing region.

7. The device according to claim 5, including a driven draw-in roller, and said guide plate has a further guide plate orifice formed therein for receiving said driven draw-in roller, said further guide plate orifice disposed next to said guide plate orifice, and said guide plate orifice for said driven transport drum being offset to said further guide plate orifice in the Z-direction.

8. The device according to claim 5, including a non-driven draw-in roller disposed in said second orifice of said feed deck, said first orifice and said second orifice of said feed deck are disposed next to one another such that said first orifice is offset to said second orifice in the Z-direction.

9. The device according to claim 5, wherein said guide plate has a further guide plate orifice formed therein for detecting the print carrier and disposed next to said guide plate orifice for said driven transport drum, said guide plate orifice being offset to said further guide plate orifice in the Z-direction.

10. The device according to claim 5, wherein said second orifice of said feed deck is provided for detecting the print carrier and is disposed next to said first orifice of said feed deck such that said first orifice is offset to said second orifice in the Z-direction.

11. The device according to claim 5, wherein said non-driven back-pressure device has a first fixed bearing axle, a resilent rocker mounted pivotably about said first fixed bearing axle, a first axle fastened on said resilent rocker, and a first tension spring acting on said resilent rocker, said non-driven back-pressure rollers are mounted rotatably on said first axle and act on the print carrier through said first orifice in said feed deck by a spring force of said first tension spring.

12. The device according to claim 11, including:

a pilot control mechanism having a front and disposed upstream of said non-driven back-pressure device, said pilot control mechanism having a second fixed bearing axle, a sprung rocker disposed at said front along the transport path and is mounted pivotably about said second fixed bearing axle, a second axle fastened to said sprung rocker, a second tension spring acting on said sprung rocker, and a non-driven draw-in roller mounted rotatably on said second axle;

an upper draw-in roller disposed above said non-driven draw-in roller and said non-driven draw-in roller acting on one of said upper draw-in roller and on the print carrier through said second orifice in said feed deck by a spring force of said second tension spring; and a lifting rod coupling said sprung rocker to said resilent rocker in such a way that a movement of said sprung rocker caused by a thickness of the print carrier is transmitted at least partially to said resilent rocker being a rear rocker.

13. The device according to claim 12, wherein said first tension spring has a spring constant being substantially higher than that of said second tension spring.

14. The device according claim 13, wherein:

said sprung rocker and said resilent rocker are each formed of two angle levers including a first angle lever and a second angle lever each having legs including a first leg and a second leg;

said sprung rocker and said resilent rocker each have a first spacer piece connected between said first leg of said two angle levers, a second spacer piece connected between said first leg and said second leg of each of said two angle levers, and a bolt fastened to said second leg of said first angle lever and said second leg of said second angle lever for spring suspension.

15. The device according to claim 14, wherein said lifting rod has a first hole and a second hole formed therein at opposite ends of said lifting rod, said sprung rocker has a further bolt disposed along the transport path and held in said first hole at one end of said lifting rod, and said bolt of said rear rocker is disposed along the transport path and held in said second hole at the other end of said lifting rod.

16. The device according to claim 1, wherein said non-driven back-pressure device has at least one non-driven back-pressure conveyor belt; and rollers supporting said at least one non-driven back pressure conveyor belt;

said at least one non-driven back-pressure conveyor belt exerting a spring pressure in the y-direction on said transport drum.

17. The device according to claim 16, wherein:

said non-driven back-pressure device has a sprung long rocker, first axles fastened on said sprung long rocker, and supporting rollers mounted rotatably on said first axles, said non-driven back-pressure conveyor belt running on said supporting rollers;

said non-driven back pressure device having second axles fastened on said sprung long rocker and deflecting rollers for said non-driven back-pressure conveyor belt are mounted rotatably on second axles;

said non-driven back pressure device having a sprung short rocker, a third axle fastened on said sprung short rocker, and a non-driven lower draw-in roller mounted rotatably on said third axle;

said non-driven back pressure device having a common fixed bearing axle and said sprung long rocker and said sprung short rocker are mounted pivotably about said common fixed bearing axle; and said non-driven back pressure device having a feed deck with a first orifice and a second orifice formed therein, a first compression spring and a second compression spring, said non-driven back-pressure conveyor belt acting on the print carrier through said first orifice in said feed deck by a spring force of said first compression spring, and said non-driven lower draw-in roller acting on the print carrier through said second orifice in said feed deck by a spring force of said second compression spring.

18. The device according to claim 17, wherein first compression spring has a spring constant substantially higher than that of said second compression spring.

19. The device according to claim 17, including locking nuts fastening said second axles to said sprung long rocker.

20. The device according to claim 1, including at least one friction covering resting annularly against a circumference of said driven transport drum.

21. The device according to claim 1, wherein said driven transport drum has a bearing axle;

including a worm wheel, a drive belt, and a driving wheel driven by said drive belt disposed near one end face of said driven transport drum on said bearing axle of said driven transport drum;

including a motor driving said driven transport drum, said motor having a motor axle and a worm pinion disposed on said motor axle and engaging said worm wheel;

including a driven wheel; and including an upper draw-in roller coupled to said driven wheel which is driven by said drive belt.

22. The device according to claim 21, wherein said driving wheel and said driven wheel are toothed-belt wheels, and said drive belt is a toothed belt.

23. The device according to claim 21, including an encoder disk, which can be sensed by a light barrier in an encoder, disposed on said motor axle.

24. The device according to claim 1, wherein said driven transport drum has an end face with markings disposed on said end face, near a circumference of said driven transport drum to be read by an encoder.

* * * * *